US008286265B2

(12) United States Patent
Karwan

(10) Patent No.: US 8,286,265 B2
(45) Date of Patent: Oct. 16, 2012

(54) ILLUMINATED HAT CONFIGURED FOR THROWING

(76) Inventor: Sihar Ahmad Karwan, Alexandria, VA (US)

( * ) Notice: Subject to any disclaimer, the term of this patent is extended or adjusted under 35 U.S.C. 154(b) by 607 days.

(21) Appl. No.: 12/458,307

(22) Filed: Jul. 8, 2009

(65) Prior Publication Data

US 2011/0004975 A1 Jan. 13, 2011

(51) Int. Cl.
*A42B 1/00* (2006.01)

(52) U.S. Cl. ..... 2/175.5; 2/175.1; 2/209.11; 2/209.13

(58) Field of Classification Search ..... 2/209.11, 2/209.13, 209.5, 175.1, 175.4, 175.5; 446/36, 446/47

See application file for complete search history.

(56) References Cited

U.S. PATENT DOCUMENTS 5,287,561 A 2/1994 Spector
5,674,102 A 10/1997 Lin
5,915,533 A 6/1999 Helle
6,061,835 A 5/2000 Lien

*Primary Examiner* — Khoa Huynh
*Assistant Examiner* — S. Cline

(57) ABSTRACT

A article of clothing suitable for providing protection from the elements and wearable on the head having means of securing and directing illuminants whereby providing its user safety in low light. The article of clothing is further configured to be airborne providing its user with entertainment such as a light show and exercise both day and night.

10 Claims, 4 Drawing Sheets

ILLUMINATED HAT CONFIGURED FOR THROWING

BACKGROUND OF THIS PRESENT EMBODIMENT

Field of this Present Embodiment

This present embodiment relates in general to an article of clothing wearable on the head comprising of a means for securing and/or directing a luminous and configured to be airborne.

PRIOR ART

By Patent Numbers:

| | | | |
|---|---|---|---|
| 6,061,835 | May 2000 | Lien | 2/175.5 |

Shape-Changeable Hat

The disadvantage of Lien's patent application '835 for his hat is that it has no means of securing a light source or providing a light for safety or for entertainment.

| | | | |
|---|---|---|---|
| 5,287,561 | February 1994 | Spector | 2/209.11 |

Convertible Fabric Hat and Package Therefor

The disadvantage of Spector's patent '561 for his hat is that it requires the child to convert the hat into a flying sphere by first inserting a balloon in a split on the under side of the crown and then inflating the balloon. Not only does the child need a balloon, the child must first convert the hat before play can begin. Once the balloon is inflated, the hat will not have a great range of flight because the shape of the hat allows the airflow of the top and the bottom of the hat to be the same, thus there is no lift. The weight is also not distributed properly for the hat to fly. For Spector's hat to have any range, the balloon must be filled with water to add weight to the ball so that the range may be increased.

Foreign Patent Documents

Not Applicable

The patents listed below are hats and/or have means for flight such as Frisbees, but do not intrude on the scope of this present embodiment:

| | | | |
|---|---|---|---|
| 5,915,533 | June 1999 | Halle | 2/175.5 |
| 5,674,102 | October 1997 | Lin | 446/46 |
| 4,357,020 | November 1982 | Van Bryant | 273/424 |
| 5,358,440 | October 1994 | Zheng | 446/48 |
| 4,115,946 | September 1978 | Vukmirovich | 46/74 |
| 3,571,811 | May 1971 | Wilson | 2/195 |
| 4,201,009 | May 1980 | Burvidge | 46/1 |

BRIEF SUMMARY OF THIS PRESENT EMBODIMENT

This present embodiment is also known as an Unidentified Flying Hat (UFH for short) and exhibits an article of clothing such as a hat wearable on the head. The article of clothing is suitable for providing protection from the elements and further includes a means for illuminating and/or securing illumination, whereby providing its user with safety at low visibility due to lack of light. The article of clothing is further configured to be airborne providing its user with entertainment, day or night.

BRIEF DESCRIPTION OF THE DRAWINGS

Description of Figures

Figure 1:
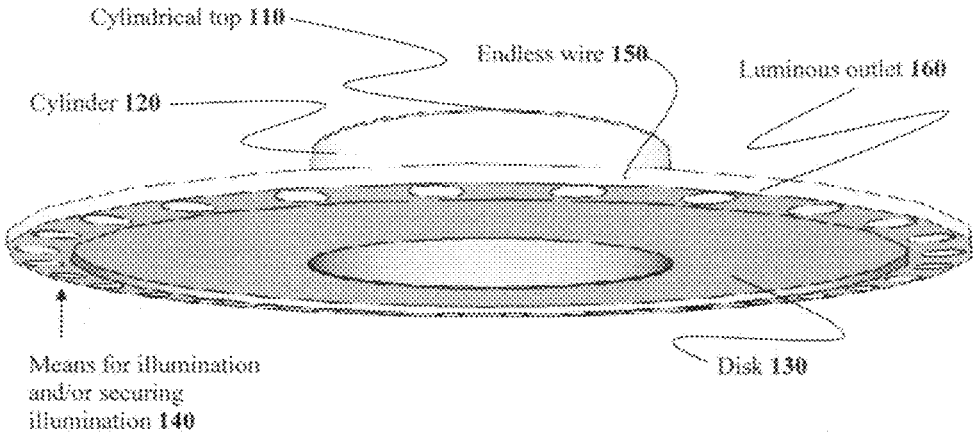
Figure 1A:
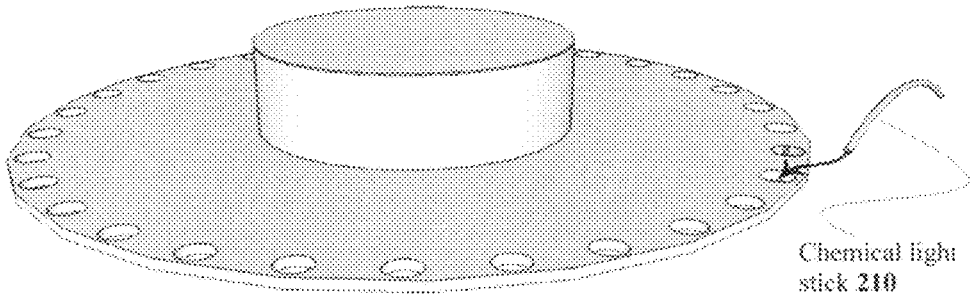

FIG. 1 is a depiction of this present embodiment's bottom perspective view.

Figure 2:
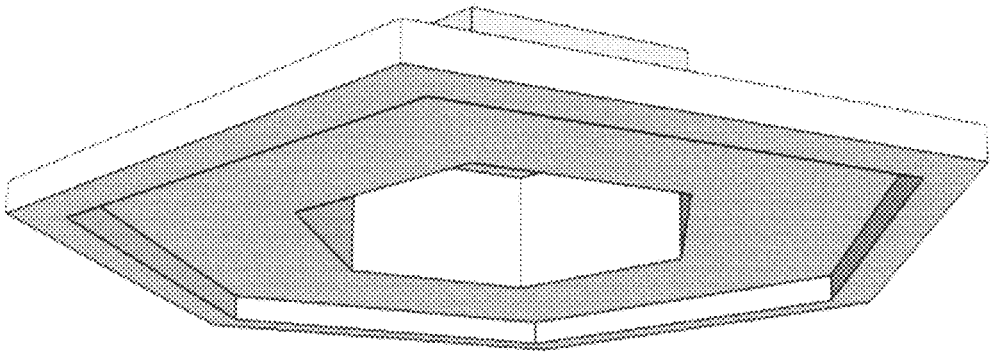

FIG. 2 is a depiction of this present embodiment's top perspective view.

FIG. 3 is a depiction of this present embodiment's operational view.

FIG. 4 is a depiction of an alternative shape of this present embodiment's bottom perspective view.

DESCRIPTION OF REFERENCE NUMERALS

| DESCRIPTION OF REFERENCE NUMERALS | |
|---|---|
| 110 | Cylindrical top |
| 120 | Cylinder |
| 130 | Brim Disk |
| 140 | Means for illuminating and/or securing illumination |
| 150 | Endless wire |
| 160 | Luminous outlets |
| 210 | Chemical light stick |
| 310 | Means for auto flight adjust |

DETAILED DESCRIPTION OF THE DRAWINGS

Specifications

The illustrations shown in FIG. 1 show the various parts of this present embodiment, such as the cylindrical top 110. The Cylindrical top 110 has two functions. The first function is to protect the users head from the elements such as the sun. The second function of the cylindrical top 110 is to capture air when the UFH is airborne and is slowed down due to air friction. When the UFH is slowed down, its lift is reduced at the same time gravity pulls the UHF causing the UFH to descend. To slow its descent the UFHs cylindrical top 110 fills with air like a parachute. This parachute effect slows down the UHF descend and therefore increases its range. The cylindrical top 110 joins the cylinder 120 on its outer cylinder edge to create a cylindrical enclosure. The cylindrical top 110 and the cylinder 120 make up the crown. The crown can take on other shapes such as a dome like structure.

Figure 1B:
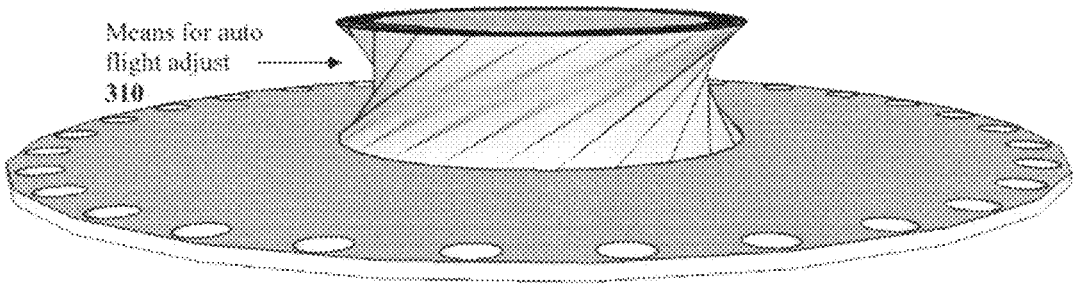

The cylinder 120 is constructed of fabric that has greater vertical and horizontal rigidity than that of its diagonal rigidity. Weaving the vertical strings perpendicularly to the horizontal strings and omitting the diagonal weaves accomplishes this greater vertical and horizontal rigidity and a weak diagonal rigidity. This greater vertical and horizontal rigidity allows the cylindrical top 110 to be lowered when the UHF is flung by using centrifugal acceleration to cause the vertical strings to lean. The lowering and rising of the cylindrical top 110 is known as the means for auto flights adjust 310 and is best seen in FIG. 1B. The Cylindrical top 110 returns or rises to its normal shape when the centrifugal force is reduced due to air friction and drag. Both the cylindrical top 110 and the cylinder 120 are made up of lightweight material and are limited in the number of sewn joints. Keeping the weight low and the number of joints to a minimum allows for a longer and more accurate flight due to a more uniformed center of mass. The cylinder 120 joins a brim referred to from here on as a disk 130 to form a perpendicular joint on the disk 130 inner circumference.

Although all the fabrics that make up the UFH can be kept the same, the UFH has improved flight if the fabric that forms the disk 130 is heavier in gauge both in size and in weight compared to the cylinder 120 and cylindrical top 110. When the UFH is flung in the air, the means for illuminating and/or securing illumination 140 cuts two air paths in the air. The disk 130 acts as a baffle keeping the air path split and allowing the faster moving air on its topside to pull the UFH in an upward direction. The disk 130 joins the means for illuminating and/or securing illumination 140 on its outer circumference.

The means for illuminating and/or securing illumination 140 has four functions, they are:

1) Securing an endless wire 150
2) Securing illuminates 210
3) Provides luminous outlet 160
4) Creating two air paths
5) Stabilizing the UFH The means for illuminating and/or securing illumination 140 provides a pocket by wrapping a fabric around the endless wire 150 and joining the two ends of the fabric to the outer circumference of the disk 130. This pocket secures the endless wire 150, which is used to help keep the shape of the fabric disk 130. The pocket also allows the insertion of illuminates 210 such as chemical light sticks and L.E.Ds. The illuminates 210 are inserted into the means for illuminating and/or securing illumination 140 from one of the luminous outlet 160. Alternatively, light sources such as L.E.Ds can be configured into the UFH eliminating the means for illuminating and/or securing illumination 140 and the luminous outlet 160. The series of illuminates 210 can be inserted one at a time or a single illuminates 210 can be inserted all at once. The illuminates 210 illuminate outwards through the luminous outlet 160. The luminous outlet 160 and the endless wire 150 can be any shape or size such as a ring, square, or star to shape the UFH. The means for illuminating and/or securing illumination 140 has a leading outer edge that cuts through the air creating two paths. The two air paths are kept separate as described above, lift is created due to a longer air path in the direction of the desired lift. This increase in air path distance can be accomplished by shaping the means for illuminating and/or securing illumination 140 to incorporate a flat bottom and a dome like top. Additionally, the means for illuminating and/or securing illumination 140 contains most of the weight of the UFH. When the UFH is flung, the centripetal force around its fixed center axis creates a gyroscope rotation effect. This gyroscope rotation of a non-uniformly distributed mass around a fixed axis creates a uniform center of mass. The creation of a center of mass stabilizes the UFH and allows for a longer and a more accurate flight.

FIG. 2 depicts one of several alternative shapes that can be realized with this present embodiment. Other shapes such as combining the cylindrical top 110 and the cylinder 120 to form a crown or a dome like shape are also possible. FIG. 2 also shows the means for illuminating and/or securing illumination 140 made of a transparent material eliminating the need for luminous outlet 160. The UFH is configured to further include batteries, light control circuitry, glow, indiglow, and/or reflective materials. The UFH is also configured to be collapsible, (not shown but conventionally known in the art) such as automobile dash grads used to reflect the sun's rays.

ADVANTAGES

This present embodiment has several advantages over prior art; some of the advantages will be made apparent below:

a) This present embodiment looks similar to traditional hats.
b) This present embodiment is configured to provide both passive and active illuminates for safety and/or entertainment.
c) This present embodiment is collapsible and lightweight allowing this present embodiment to be easily transported.
d) This present embodiment is configured to fly without having to be altered or manipulated.
e) This present embodiment is configured to auto configure its shape for fast or slow flight.
f) This present embodiment provides protection form the elements such as the sun and rain.
g) This present embodiment provides a light show when flung or worn on the head.
h) This present embodiment has a longer and more accurate flight over other airborne headgear.

CONCLUSION, RAMIFICATIONS, AND SCOPE

This present embodiment provides safety in low visibility due to lack of light and offers protection form the elements. This present embodiment can be used as a festive accessory in celebrations of birthdays, bachelor parties, $4^{th}$ of July, Mardi Gras, and Halloween to state a few. Additionally, this present embodiment provides entertainment both night and day and can be used as a flying toy similar to a Frisbee to provide exercise and entertainment. This present embodiment also provides entertainment by creating a light show displaying a series of colorful rotating lights in the sky above.

Many examples, depictions, drawings, specifications, and such have been given in general regarding this present embodiment. These examples, depictions, drawings, specifications, and such must not be used in limiting the scope of this present embodiment. For example, altering or evolving this present embodiment can realize other similar embodiments, alterations such as making means for illuminating and/or securing illumination 140 in the form of a series of loops, making the means for illuminating and/or securing illumination 140 out of rubber or other material, making this present embodiment out of other material such as plastic or rubber, changing the shape of the cylindrical top 110 to a dome or oval shape, changing the cylinder 120 into an elongated cylinder or oval, using light rods, glow sticks, or other chemical or electrical light source making this present embodiment to reflect or glow in the dark, adding active illuminants such as L.E.D.s, adding, eliminating, or altering other numerous components and parts. Other examples include using different materials, sizes, colors, making all the luminous outlet elongated, or of different shape, or molding this present embodiment without joints, altering, adding, or eliminating parts to perform similar functions, etc. Therefore, the scope of this present embodiment should be determined by the appended claims and their legal equivalents, rather than by the examples given.

I claim:

1. A flying hat comprising:

a crown configured to be worn on a human head;

said crown comprises a cylindrical top joined to a cylinder on an outer edge of said cylinder to create a cylindrical enclosure, said crown is woven with vertical strings perpendicular to horizontal strings, with the diagonal weave omitted, to give said crown great vertical rigidity, and horizontal rigidity, and weak diagonal rigidity;

a brim disk having a wire which keeps the shape of said brim disk;

said crown joining said brim disk for providing a baffle for lift;

a means for auto flight adjust which comprises a lowering and rising of said cylindrical top;

wherein said crown is designed and constructed of material that has vertical rigidity and said horizontal rigidity is greater in strength than said diagonal rigidity so as to provide said means for auto flight adjust, wherein when said flying hat is flung, a centrifugal acceleration causes said vertical strings to lean and therefore lower said cylindrical top;

said cylindrical top rises to its normal shape when the centrifugal force is reduced due to air friction and drag, said cylindrical top fills with air and acts like a parachute to slow down a descent of said flying hat and therefore increase the flying range;

said flying hat is configured to fly in a direction desired by a user;

wherein said crown is designed with material lighter in gauge mass than said brim disk;

wherein said brim disk is designed with material heavier in gauge mass than said crown so as to create an axis of centrifugal acceleration to assist the gyroscopic rotational effect;

wherein when said flying hat is flung in said desired direction, a centripetal force around a fixed center axis of said flying hat creates the gyroscope rotation effect, the gyroscope rotation of a non-uniformly distributed mass around a fixed axis creates a uniform center of mass, a creation of a center of mass stabilizes the flying hat and allows for a longer and a more accurate flight;

wherein said brim disk has an outer circumference, said outer circumference having means for illuminating and/or securing illumination, said means of illuminating and/or securing comprises a plurality of illuminating outlets that allow illuminated light sources to be inserted into said outlet;

said means for illuminating and/or securing is used to secure said wire to help keep said brim disk in its shape, said means for illuminating and/or securing having a leading edge that cuts through the air creating two paths, the two air paths are kept separate allowing the faster moving air on a topside of said flying hat to pull said flying hat in an upward direction.

2. The article of clothing of claim 1, wherein said illumination comprises at least one light emitting diode.

3. The article of clothing of claim 1, wherein said illumination comprises at least one chemical light source.

4. The article of clothing of claim 1, wherein said illumination is made of a reflective material or coding.

5. The article of clothing of claim 1, wherein said means for illuminating and/or securing illumination comprises at least one luminous outlet.

6. The article of clothing of claim 1, wherein said means for illuminating and/or securing illumination is configured with a transparent material.

7. The article of clothing of claim 1, wherein said means for illuminating and/or securing illumination is configured with an opaque material.

8. The article of clothing of claim 1, wherein said means for illuminating and/or securing illumination is configured with a rigid material.

9. The article of clothing of claim 1, wherein said article is configured to be collapsible for storage or transporting without damaging said article.

10. The article of clothing of claim 1, wherein said illumination is made of a glow or indiglow material.

* * * * *